US008183962B2

(12) United States Patent
Zhang et al.

(10) Patent No.: US 8,183,962 B2
(45) Date of Patent: May 22, 2012

(54) LEAKAGE PROTECTIVE PLUG

(76) Inventors: Keqing Zhang, Tangxia Dongguan (CN); Junxin Li, Tangxia Dongguan (CN)

( * ) Notice: Subject to any disclaimer, the term of this patent is extended or adjusted under 35 U.S.C. 154(b) by 40 days.

(21) Appl. No.: 12/920,940

(22) PCT Filed: Mar. 4, 2009

(86) PCT No.: PCT/CN2009/000227

§ 371 (c)(1), (2), (4) Date: Sep. 3, 2010

(87) PCT Pub. No.: WO2009/109106

PCT Pub. Date: Sep. 11, 2009

(65) Prior Publication Data

US 2011/0002071 A1 Jan. 6, 2011

(51) Int. Cl.

| | |
|---|---|
| ***H01H 75/00*** | (2006.01) |
| ***H01H 73/12*** | (2006.01) |
| ***H01H 73/00*** | (2006.01) |
| ***H01H 83/06*** | (2006.01) |
| ***H01H 9/20*** | (2006.01) |

(52) U.S. Cl. ..... 335/18; 335/2; 335/6; 335/21; 335/26; 335/34; 335/40; 335/113; 335/168; 335/185; 335/190; 335/166; 361/42

(58) Field of Classification Search ..... 335/18, 335/2, 6, 21, 40, 26, 34, 113, 168, 185, 190, 335/166; 361/42–50

See application file for complete search history.

(56) References Cited

U.S. PATENT DOCUMENTS

| | | | | |
|---|---|---|---|---|
| 2,462,892 | A * | 3/1949 | O'Brien et al. | 335/18 |
| 3,335,375 | A * | 8/1967 | Fujita | 335/18 |
| 4,010,431 | A * | 3/1977 | Virani et al. | 335/18 |
| 2008/0094764 | A1 * | 4/2008 | Zhang et al. | 361/42 |

* cited by examiner

*Primary Examiner* — Mohamad Musleh

(57) ABSTRACT

A leakage protective plug comprises a case and electric contacts. A protective cap is fixed on the top of the case and includes a reset button protective cap and a test button protective cap. The reset button protective cap is interiorly provided with a reset button connected with a push rod which in order penetrates an electric contact upper panel, an upper spring, an electric contact lower panel and a lower spring. The electric contact upper panel is provided at a right side thereof with a locking member linked with a brake connecting rod which is linked with a brake plate. The brake plate is located at a lower right side of the locking member. Below the brake plate are disposed an electromagnet pole shoe, an electromagnet coil, and an electromagnet core. The test button protective cap is provided with a test button having a test electric contact.

6 Claims, 4 Drawing Sheets

LEAKAGE PROTECTIVE PLUG

BACKGROUND OF THE INVENTION

1. Field of the Invention

The present invention relates to a leakage protective device; and more particularly to a leakage protective plug.

2. Description of the Prior Art

In the existing electrical products, electric leakage or shot circuit fault caused by man-made or accident damage or material aging or external substances penetration might lead to electric shock, fire disaster and the like. In addition, during the use of the plug, once the power is cut off but the plug is still connected with the socket, the plug will directly supply power to the electric equipment after the recovery of the power, which is not good for protection of electric equipments and human safety.

The present invention has arisen to mitigate and/or obviate the afore-described disadvantages.

SUMMARY OF THE INVENTION

The primary objective of the present invention is to provide a safety and reliable leakage protective plug.

To achieve the above objective, the leakage protective plug in accordance with the present invention comprises a case and electric contacts. A protective cap is fixed on the top of the case and includes a reset button protective cap and a test button protective cap. The reset button protective cap is interiorly provided with a reset button connected with a push rod, and the push rod in order penetrates an electric contact upper panel, an upper spring, an electric contact lower panel and a lower spring. The electric contact upper panel is provided at a right side thereof with a locking member, and the locking member is linked with a brake connecting rod which is linked with a brake plate. The brake plate is located at a lower right side of the locking member. Below the brake plate are disposed an electromagnet pole shoe, an electromagnet coil, and an electromagnet core. The test button protective cap is interiorly provided with a test button having a test electric contact.

The electric contact upper panel has an upper end and a lower end that are each connected to an upper electric contact, and the electric contact lower panel has an upper end and a lower end that are each connected to a lower electric contact.

The push rod is provided with a protruding stage to be matched with a concave groove formed in the electric contact upper panel.

A transparent portion is disposed between the reset button protective cap and the test button protective cap.

The locking member is provided with a locking platform for locking the electric contact upper panel.

The reset button protective cap and the test button protective cap are integrally formed.

The leakage protective plug in accordance with the present invention has the following advantages:

1. When an electrical product connected to the leakage protective plug of the present invention suffers from the faults of electric leakage or short circuit, the leakage protective plug of the present invention can automatically cut off the power source in time, preventing the occurrence of disasters while ensuring the safety of the electrical product.

2. When the leakage protective plug of the present invention is connected to the power source, the user can manually press down the test button, so that the test system in the leakage protective plug of the present invention will check if the whole electric circuit including the load circuit is in normal working state, avoiding the occurrence of disasters.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
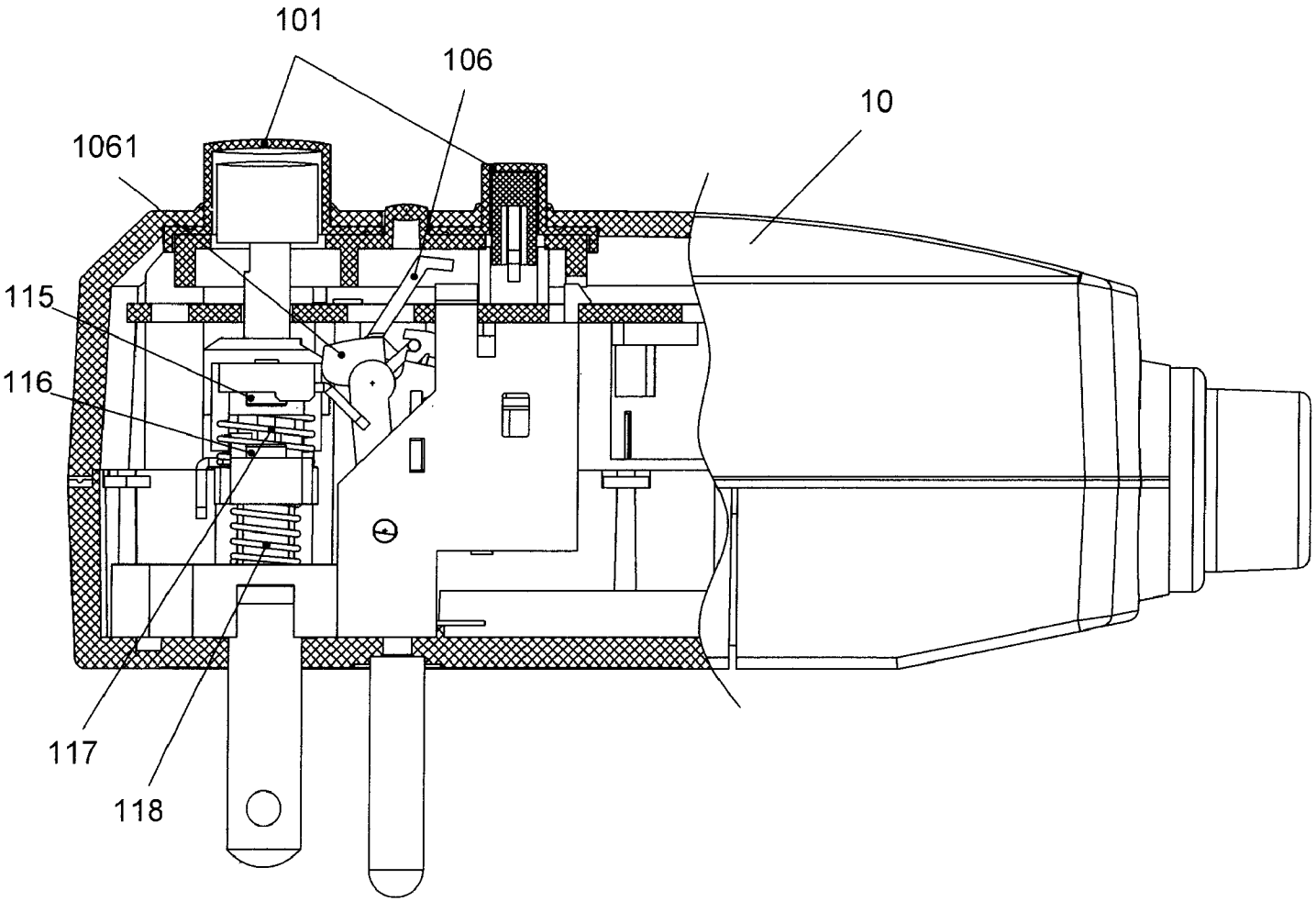
FIG. 1 is a partial cross-sectional view of a leakage protective plug in accordance with the present invention which is not connected to the power source.
Figure 2:
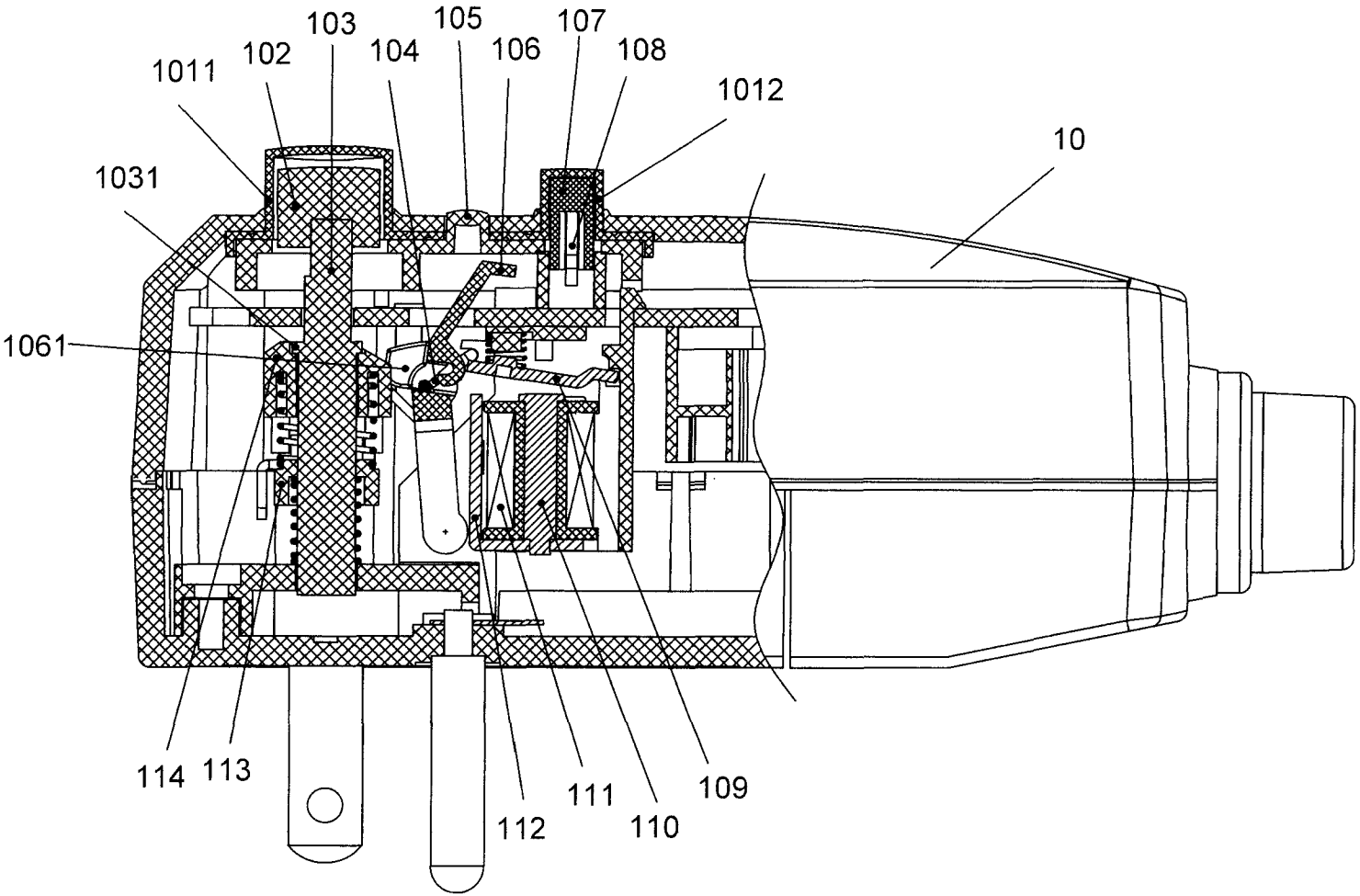
FIG. 2 is a is a partial cross-sectional view of the inner structure of the leakage protective plug in accordance with the present invention which is not connected to the power source.

Referring to FIGS. 1-2, a leakage protective plug in accordance with the present invention comprises a case 10 and conductive electric contacts disposed in the case 10. On the top of the case 10 is fixed a protective cap 101. The protective cap 101 includes a reset button protective cap 1011 and a test button protective cap 1012. The reset button protective cap 1011 is interiorly provided with a reset button 102 connected with a push rod 103. The push rod 103 in order penetrates an electric contact upper panel 114, an upper spring 117, an electric contact lower panel 113 and a lower spring 118. The electric contact upper panel 114 is provided at a right side thereof with a locking member 106. The locking member 106 is linked with a brake connecting rod 104 which is linked with a brake plate 109 located at the lower right side of the locking member 106. Below the brake plate 109 are disposed an electromagnet pole shoe 112, an electromagnet coil 111, and an electromagnet core 110. The test button protective cap 1012 is interiorly provided with a test button 107 having a test electric contact 108.

It is to be noted that, the electric contact upper panel 114 has an upper end and a lower end that are each connected to an upper electric contact 115, and the electric contact lower panel 113 has an upper end and a lower end that are each connected to a lower electric contact 116. The push rod 103 is provided with a protruding stage 1031 to be matched with a concave groove 1141 formed in the electric contact upper panel 114. In addition, between the reset button protective cap 1011 and the test button protective cap 1012 is provided a transparent portion 105 for the user to view if the leakage protective plug of the present invention is in working state therethrough. The locking member 106 is provided with a locking platform 1061 for locking the electric contact upper panel 114. To make the structure more simplified, the reset button protective cap 1011 and the test button protective cap 1012 are integrally formed in the present embodiment.

The aforementioned is the summary of the positional and structural relationship of the respective components of the preferred embodiment in accordance with the present invention.

For a better understanding of the present invention, its operation and function, reference should be made to FIGS. 1-4:

Referring to FIGS. 1-2 which illustrate the leakage protective plug in accordance with the present invention is in an off-working state, the upper electric contact 115 on the electric contact upper panel 114 and the lower electric contact 116 on the electric contact lower panel 113 are disconnected. Furthermore, a top of the locking member 106 is not located under the transparent portion 105, showing that the leakage protective plug in accordance with the present invention is in the off-working state.

Figure 3:
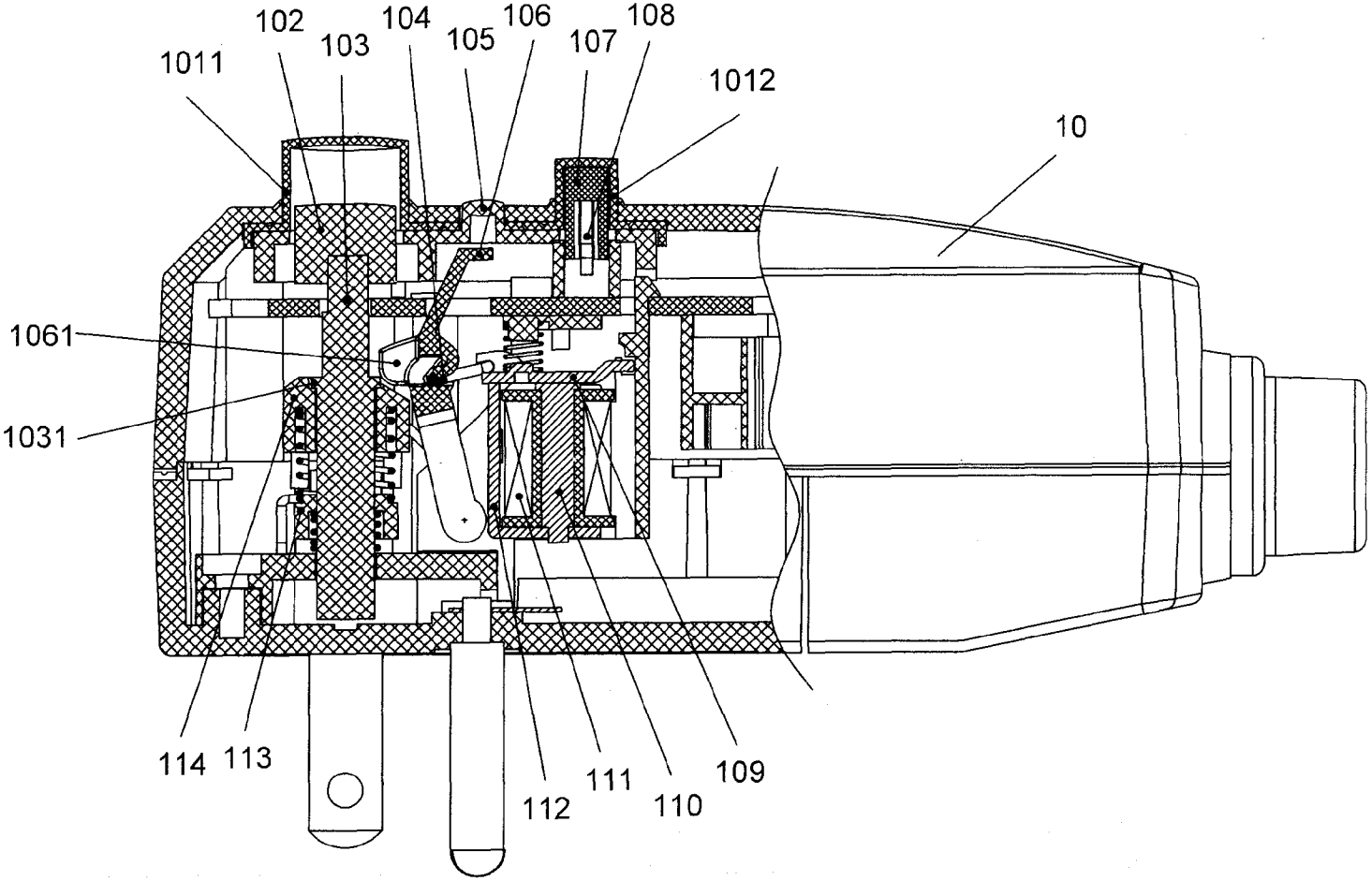
FIG. 3 is a partial cross-sectional view showing that the leakage protective plug in accordance with the present invention is connected to the power source while the reset button is pressed down.
Figure 4:
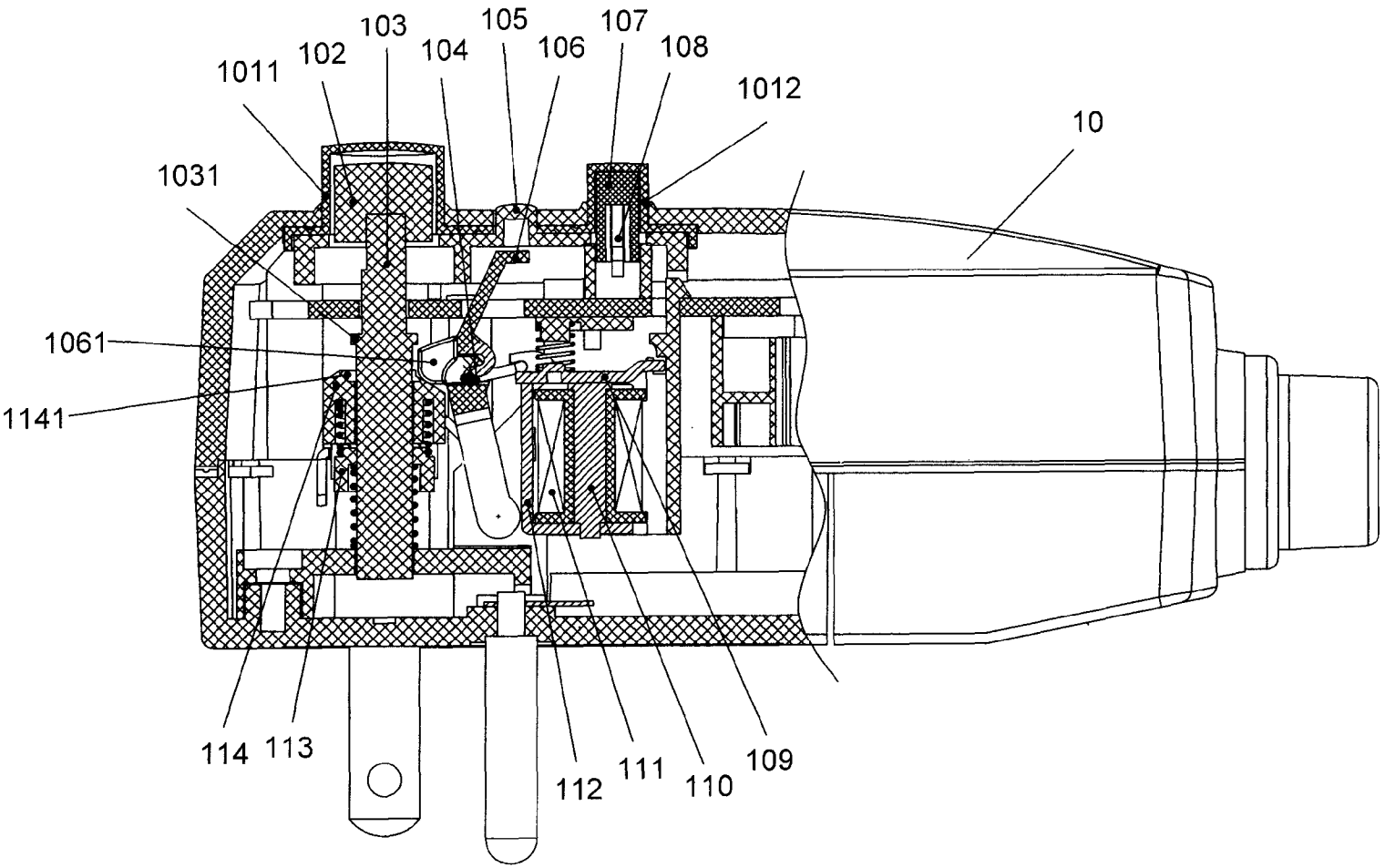
FIG. 4 is a partial cross-sectional view of the inner structure of the leakage protective plug in accordance with the present invention which is in working state.

Referring to FIG. 3, after the leakage protective plug in accordance with the present invention is connected to a power supply, the reset button 102 will be pressed down through the reset button protective cap 1011, and the push rod 103, the electric contact upper panel 114, the electric contact lower panel 113 will all be pushed by the reset button 102 to move axially downwards, at this moment, an electromagnet mechanism consisting of the electromagnet core 110, the electromagnet coil 111, and the electromagnet pole shoe 112 will be electrified and have an attracting force. Subsequently, the brake plate 109 will be combined on the electromagnet mechanism under the action of the attracting force of the electromagnet mechanism and an electric force of the spring above the brake plate 109 while moving the brake connecting rod 104 to make the locking platform 1061 of the locking member 106 adjacent the push rod 103. When the reset button 102 which has been pressed down is released, the reset button 102, the push rod 103, the electric contact upper panel 114, the electric contact lower panel 113 will be made to move upwards by the upper spring 117 and the lower spring 118. During the moving process, the electric contact upper panel 114 cannot return to its original position since it is obstructed by the locking platform 1061 of the locking member 106 which is locked by the electromagnet mechanism, but the electric contact lower panel 113, but the reset button 102 and the push rod 103 will continue moving upwards until the lower electric contact 116 on the upper end of the electric contact lower panel 113 and the upper electric contact 115 on the lower end of the electric contact upper panel 114 are brought into contact with each other, as shown in FIG. 4. At this moment, the leakage protective plug in accordance with the present invention is turned on and outputting electric energy. Meanwhile, the top of the locking member 106 is located under the transparent portion 105 and can be viewed through the transparent portion, showing that the leakage protective plug in accordance with the present invention is in a working state.

Referring to FIG. 4, the test button 107 can be pressed down to make a test system in the leakage protective plug to check if the whole electric circuit including the load circuit is in normal working condition, thus avoiding the occurrence of electric leakage. In addition, when the electrical product connected to the leakage protective plug of the present invention suffers from the electric leakage or the fault of short circuit, a control circuit will automatically cut off the power source of the electromagnet coil 111 to release the attracting force of the electromagnet mechanism consisting of the electromagnet core 110, the electromagnet coil 111, and the electromagnet pole shoe 112, so that under the action of the upper spring 117 and the lower spring 118, the electric contact upper panel 114 and the electric contact lower panel 113 will move upwards to push away the locking member 106, thus releasing the electric contact upper panel 114. As a result, the lower electric contact 116 and the upper electric contact 115 are disconnected, thus cutting off the output circuit of the leakage protective plug of the present invention. The leakage protective plug of the present invention restores to the state as shown in FIG. 1.

While we have shown and described various embodiments in accordance with the present invention, it is clear to those skilled in the art that further embodiments may be made without departing from the scope of the present invention.

What is claimed is:

1. A leakage protective plug comprising: a case and electric contacts disposed in the case, wherein: a protective cap is fixed on a top of the case and includes a reset button protective cap and a test button protective cap, the reset button protective cap is interiorly provided with a reset button connected with a push rod, the push rod in order penetrates an electric contact upper panel, an upper spring, an electric contact lower panel and a lower spring, the electric contact upper panel is provided at a right side thereof with a locking member, the locking member is linked with a brake connecting rod which is linked with a brake plate, the brake plate is located at a lower right side of the locking member, below the brake plate are disposed an electromagnet pole shoe, an electromagnet coil, and an electromagnet core, the test button protective cap is interiorly provided with a test button having a test electric contact.

2. The leakage protective plug as claimed in claim 1, wherein the electric contact upper panel has an upper end and a lower end that are each connected to an upper electric contact, and the electric contact lower panel has an upper end and a lower end that are each connected to a lower electric contact.

3. The leakage protective plug as claimed in claim 1, wherein the push rod is provided with a protruding stage to be matched with a concave groove formed in the electric contact upper panel.

4. The leakage protective plug as claimed in claim 1, wherein a transparent portion is disposed between the reset button protective cap and the test button protective cap.

5. The leakage protective plug as claimed in claim 1, wherein the locking member is provided with a locking platform for locking the electric contact upper panel.

6. The leakage protective plug as claimed in claim 1, wherein the reset button protective cap and the test button protective cap are integrally formed.

* * * * *